US006307448B1

(12) United States Patent
Atokawa et al.

(10) Patent No.: US 6,307,448 B1
(45) Date of Patent: Oct. 23, 2001

(54) FREQUENCY-VARIABLE-TYPE FILTER, ANTENNA DUPLEXER, AND COMMUNICATION APPARATUS

(75) Inventors: Masayuki Atokawa; Yasuo Yamada, both of Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/368,840

(22) Filed: Aug. 5, 1999

(30) Foreign Application Priority Data

Aug. 5, 1998 (JP) ..... 10-221475

(51) Int. Cl.[7] ..... H01P 1/20

(52) U.S. Cl. ..... 333/202; 333/103; 333/262

(58) Field of Search ..... 333/101, 108, 333/104, 202, 132, 262

(56) References Cited

U.S. PATENT DOCUMENTS 5,227,748 7/1993 Sroka ..... 333/207
6,085,071 * 4/2000 Yamada et al. ..... 455/82

FOREIGN PATENT DOCUMENTS 7321509 12/1995 (JP) .

* cited by examiner

*Primary Examiner*—Robert Pascal
*Assistant Examiner*—Kimberly E Glenn
(74) *Attorney, Agent, or Firm*—Ostrolenk, Faber, Gerb & Soffen, LLP

(57) ABSTRACT

There is provided a frequency-variable-type filter, comprising: a voltage control terminal; at least one resonator; a switching device for being switched on/off by a control voltage supplied to the voltage control terminal; and the switching device being in the off-state, when a control circuit as an external circuit which is electrically connected to the voltage control terminal has high impedance at 0 V.

18 Claims, 6 Drawing Sheets

FREQUENCY-VARIABLE-TYPE FILTER, ANTENNA DUPLEXER, AND COMMUNICATION APPARATUS

BACKGROUND OF THE INVENTION

1. Field of the Invention

The present invention relates to a frequency-variable-type filter, an antenna duplexer, and a communication apparatus, for example, which are used in the microwave band.

2. Description of the Related Art

In a conventionally-known frequency-variable-type filter, a resonator is connected to a switching device such as a PIN diode or a variable capacitance diode through a capacitor or the like to perform voltage control thereof so as to vary a resonance frequency (cf. Japanese Unexamined Patent Publication No. 7-321509). When a PIN diode is used, a frequency is switched by switching it on/off, so that two bands including a band in the on-period and a band in the off-period are provided. In the on-period, usually, a positive control voltage is supplied in order to switch the PIN diode on, whereas a negative voltage is supplied in the off-period. The reason why the negative voltage is necessary in the off-period is that when high-frequency signals of large electric power are input, a high-frequency voltage is applied to the PIN diode and it is switched on, which should be avoided. In other words, when a large amount of electric power is input, the PIN diode becomes unstable and thereby the frequency characteristic varies. Consequently, this needs to be avoided.

However, in the conventional frequency-variable-type filter, in order to switch a PIN diode off, a power-supply circuit for generating a negative voltage (approximately −3 through −10 V) is required, so that the circuitry is complicated, leading to an obstacle to miniaturization and cost reduction of a mobile phone or the like.

SUMMARY OF THE INVENTION

To overcome the above describe problems, preferred embodiments of the present invention provide a frequency-variable-type filter, an antenna duplexer, and a communication apparatus, which are small and low-cost.

One preferred embodiment of the present invention provides a frequency-variable-type filter, comprising: a voltage control terminal; at least one resonator; a switching device for being switched on/off by a control voltage supplied to the voltage control terminal; and the switching device being in the off-state, when a control circuit as an external circuit which is electrically connected to the voltage control terminal has high impedance at 0 V.

Another preferred embodiment of the present invention provides a communication apparatus, comprising: a frequency-variable-type filter comprising a voltage control terminal; at least one resonator; and a switching device for being switched on/off by a control voltage supplied to the voltage control terminal; and a control circuit for supplying a control voltage to the voltage control terminal to perform voltage control of the frequency-variable-type filter; and the switching device being in the off-state when the control circuit has high impedance at 0 V.

In the above described frequency-variable-type filter and communication apparatus, a PIN diode may be used as the switching device and a dielectric resonator may be used as the resonator. Additionally, a transistor, a field-effect transistor, or the like, may be used in the control circuit, in which the impedance of the control circuit is 100 KΩ or more when the control circuit is at 0 V.

Furthermore, the anode of the PIN diode may be electrically connected to the resonator through either an inductor or a capacitor, whereas the cathode of the PIN diode may be electrically connected to a ground; and the voltage control terminal may be electrically connected to the anode of the PIN diode through a chalk coil, whereas a noise-cutting bypass capacitor may be electrically connected between the voltage control terminal and a ground. In addition, the impedance of the chalk coil may be set to be 350 Ω or more, and the capacity of the noise-cutting bypass capacitor may be set to be in a range of 10 through 1000 pF.

According to the above described structure and arrangement, even if high-frequency signals of large electric power are input when the switching device is in the off-state, since the control circuit connected to the voltage control terminal has high impedance, a negative voltage is constantly imposed on the switching device. Thus, even if high-frequency signals of large electric power are input to the frequency-variable-type filter, a stable frequency characteristic is obtainable. In addition, since there is no need of a power-supply circuit for generating a negative voltage to form a simple circuit, miniaturization and cost reduction of the communication apparatus can be achieved.

Other features and advantages of the present invention will become apparent from the following description of preferred embodiments of the invention which refers to the accompanying drawings, where like reference numerals indicate like elements to avoid duplicative description.

DESCRIPTION OF THE PREFERRED EMBODIMENTS

[First Preferred Embodiment, FIGS. 1 through 5]

Figure 1:
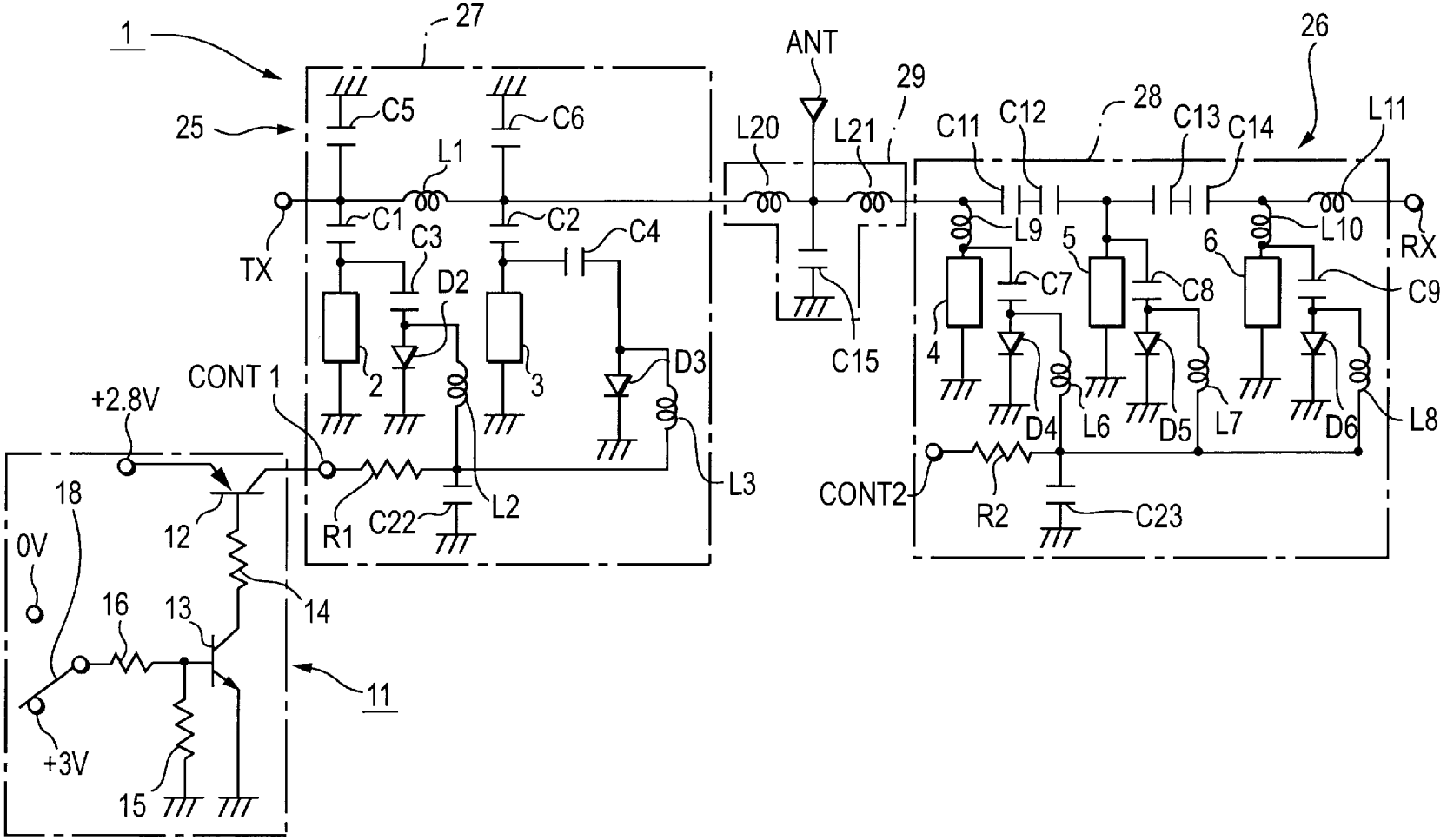
FIG. 1 is an electrical circuit diagram of an antenna duplexer and a control circuit for showing a first preferred embodiment of a communication apparatus according to the present invention.
Figure 2:
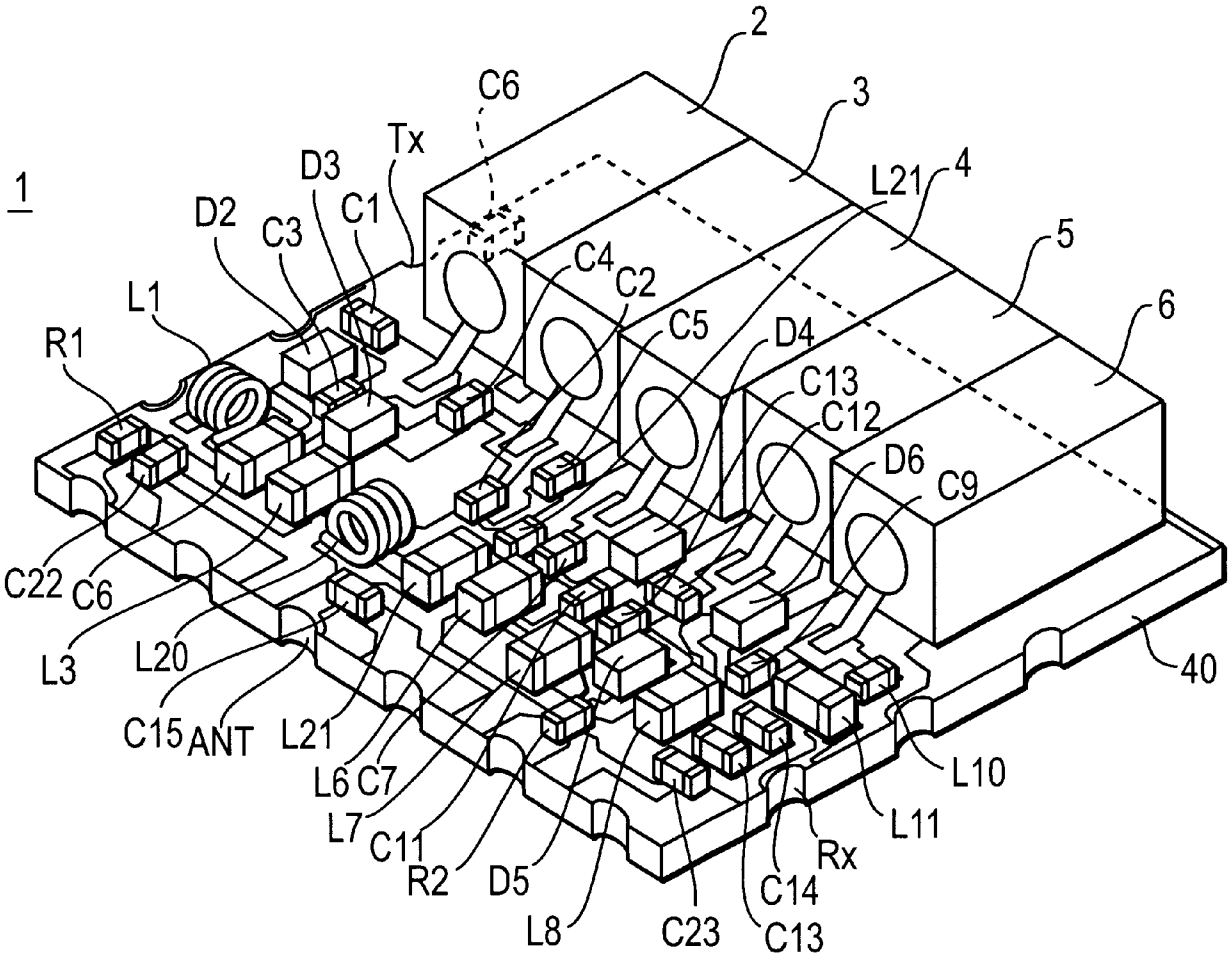
FIG. 2 is a perspective view of the structure in which the antenna duplexer shown in FIG. 1 is mounted.

FIG. 1 shows the structures of an antenna duplexer 1 and a control circuit 11 inside the communication apparatus; and FIG. 2 is a perspective view of the antenna duplexer 1 in which individual components are mounted ON a circuit substrate 40. In the antenna duplexer 1, a transmitting-side circuit 25 is electrically connected between a transmission terminal Tx and an antenna terminal ANT, whereas a receiving-side circuit 26 is electrically connected between a reception terminal Rx and the antenna terminal ANT.

The transmitting-side circuit 25 has a frequency-variable-type band block filter circuit 27 and a phase circuit 29. The band block filter circuit 27 is formed by coupling two stages of resonance circuits, in which a resonator 2 is electrically connected to the transmission terminal Tx through a resonance capacitor C1 and a resonator 3 is electrically connected to the phase circuit 29 through a resonance capacitor C2. The resonance capacitors C1 and C2 are capacitors for determining the magnitude of block-band attenuation. The series resonance circuit composed of the resonator 2 and the resonance capacitor C1 is electrically connected to the series resonance circuit composed of the resonator 3 and the resonance capacitor C2 through a coupling coil L1. In addition, capacitors C5 and C6 are electrically connected in parallel with respect to the two series resonance circuits.

A PIN diode D2 as a switching device, whose cathode is grounded, is electrically connected to the intermediate junction between the resonator 2 and the resonance capacitor C1 in parallel with respect to the resonator 2 thorough a band-varying capacitor C3. Meanwhile, a PIN diode D3 is electrically connected to the intermediate junction of the resonator 3 and the resonance capacitor C2 in parallel with respect to the resonator 3 through a band-varying capacitor C4. The anode of the PIN diode D3 is electrically connected to the band-varying capacitor C4, and the cathode of the PIN diode D3 is grounded. The band-varying capacitors C3 and C4 are capacitors for changing two attenuation-pole frequencies of the attenuation characteristic of the frequency-variable-type band block filter circuit 27.

A voltage control terminal CONT1 is electrically connected to the intermediate junction between the anode of the PIN diode D2 and the band-varying capacitor C3 through a control-voltage supplying resistor R1, a capacitor C22, and a chalk coil L2, and also it is connected to the intermediate junction between the anode of the PIN diode D3 and the band-varying capacitor C4 through the control-voltage supplying resistor R1, the capacitor C22, and a chalk coil L3. The capacitor 22, which serves as a noise-cutting bypass capacitor, is electrically connected between the voltage control terminal CONT1 and a ground. Preferably, the impedance of the chalk coils L2 and L3 is 350 Ω or more, and the capacity of the capacitor C22 is in a range of 10 through 1000 pF.

The phase circuit 29 is a T-letter-type circuit composed of a coil L20 electrically connected between the band block filter circuit 27 and an antenna terminal ANT, a capacitor C15 electrically connected between a ground and the antenna terminal ANT, and a coil L21 electrically connected between a band pass filter circuit 28 (which will be described below) of the receiving-side circuit 26 (described below) and the antenna terminal ANT.

Meanwhile, the receiving-side circuit 26 has the frequency-variable-type band pass filter circuit 28 and the phase circuit 29. In the first preferred embodiment, both the receiving-side circuit 26 and the transmitting-side circuit 25 share the phase circuit 29 for common use, but it is conceivable that the receiving-side circuit 26 and the transmitting-side circuit 25 may respectively have an individual phase circuit.

The band pass filter circuit 28 is formed by coupling three stages of resonance circuits, in which a resonator 4 is electrically connected to the phase circuit 29 through a resonance inductor L9, a resonator 6 is electrically connected to a reception terminal Rx through a resonance inductor L10, and a resonator 5 is electrically connected to the intermediate junction between the resonators 4 and 6 through coupling capacitors C11, C12, C13, and C14.

A series circuit including a band-varying capacitor C7 and a PIN diode D4 is electrically connected to the intermediate junction between the resonator 4 and the resonance inductor L9 in parallel with respect to the resonator 4, with the cathode of the PIN diode D4 being grounded. A series circuit including a band-varying capacitor C8 and a PIN diode D5 is electrically connected to the intermediate junction between the resonator 5 and the coupling capacitors C12 and C13 in parallel with respect to the resonator 5, with the cathode of the PIN diode D5 being grounded. A series circuit including a band-varying capacitor C9 and a PIN diode D6 is electrically connected to the intermediate junction between the resonator 6 and the resonance inductor L10 in parallel with respect to the resonator 6, with the cathode of the PIN diode D6 being grounded.

The voltage control terminal CONT2 is electrically connected to the intermediate junction between the anode of the PIN diode D4 and the band-varying capacitor C7 through a control-voltage supplying resistor R2, a capacitor 23, and a chalk coil L6, and is electrically connected to the intermediate junction between the anode of the PIN diode D5 and the band-varying capacitor C8 through the control-voltage supplying resistor R2, the capacitor C23, and a chalk coil L7. Furthermore, it is electrically connected to the intermediate junction between the anode of the PIN diode D6 and the band-varying capacitor C9 through the control-voltage supplying resistor R2, the capacitor 23, and a chalk coil L8. The capacitor C23, which serves as a noise-cutting bypass capacitor, is electrically connected between the voltage control terminal CONT2 and a ground. Preferably, the impedance of the chalk coils L6, L7, and L8 is 350 Ω or more and the capacity of the capacitor C23 is in a range of 10 through 1000 pF.

Figure 3:
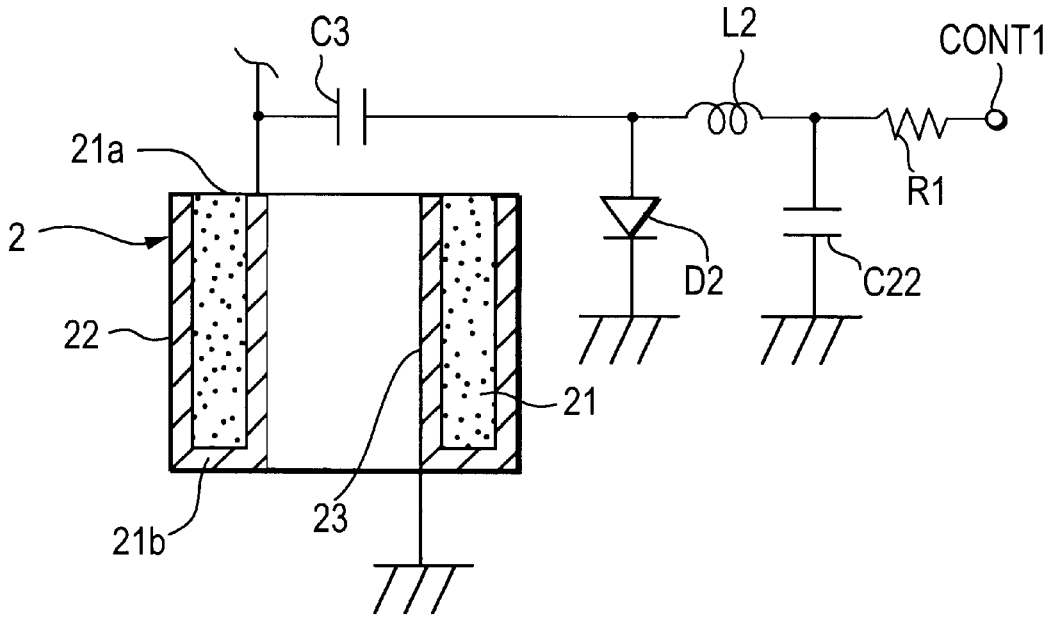
FIG. 3 is a sectional view of an example of a resonator used in the antenna duplexer shown in FIG. 1.

As the resonators 2 through 6, for example, as shown in FIG. 3, dielectric resonators are used. FIG. 3 shows the resonator 2 as a typical one. The dielectric resonators 2 through 6 are formed by a tube-shaped dielectric member 21 made of a high dielectric-constant material such as the $TiO_2$-based ceramic, an outer conductor 22 disposed on the outer periphery of the tube-shaped dielectric member 21, and an inner conductor 23 disposed on the inner periphery of the tube-shaped dielectric member 21. The outer conductor 22 is electrically open with respect to (is separated from) the inner conductor 23 at an opening-end face 21*a* of the dielectric member 21 (hereinafter referred to as an open-side end face 21*a*), whereas it is electrically short-circuited (conducted) with respect to the inner conductor 23 at the other opening-end face 21*b* (hereinafter referred to as a short-circuited-side end face 21*b*). In the dielectric resonator 2, the series circuit including the band-varying capacitor C3 and the PIN diode D2 is electrically connected to the open-side end face 21*a* in such a manner that an end of the band-varying capacitor C3 is connected to the inner conductor 23, whereas the cathode of the PIN diode D2 is grounded to a ground, and the outer conductor 22 is grounded to a ground.

Meanwhile, the control circuit 11 connected to the voltage control terminal CONT1 is formed by two transistors 12 and 13, three resistors 14, 15, and 16, and a selector switch 18. The transistor 12 is the PNP type, in which a bias voltage of +2.8 V is applied to the emitter, the collector is electrically connected to the voltage control terminal CONT1, and the base is electrically connected to the collector of the transistor 13 through the resistor 14. Meanwhile, the transistor 13 is the NPN type, in which the emitter is grounded, and the resistor 15 is electrically connected between the base and the emitter. The selector switch 18 is electrically connected to the base of the transistor 13 through the resistor 16. Either the voltage of 0 V or +3 V is applied to the base of the transistor 13 by switching the selector switch 18. Furthermore, in FIG. 1, a control circuit having the same structure as that of the control circuit 11 is connected to the voltage control terminal CONT2, but this is not shown in the figure.

A description will be given of the operational advantages of the antenna duplexer 1 and the control circuit 11 having the aforementioned structure. In this antenna duplexer 1, transmission signals input to a transmission terminal Tx from a transmission circuit system are output from an antenna terminal ANT through a transmitting-side circuit 25, and reception signals input from the antenna terminal ANT are output to a reception circuit system from a reception terminal Rx through a receiving-side circuit 26.

A trap frequency of the frequency-variable-type band block filter circuit 27 in the transmitting-side circuit 25 is determined by each resonance frequency of a resonance system formed by the band-varying capacitor C3, the resonance capacitor C1, and the resonator 2, and a resonance system formed by the band-varying capacitor C4, the resonance capacitor C2, and the resonator 3. When a voltage of +3 V is applied to the base of the transistor 13 by the selector switch 18 of the control circuit 11 connected to the voltage control terminal CONT1, as shown in FIG. 1, the transistors 12 and 13 are in the on-state and then a bias voltage of +2.8 V is applied to the voltage control terminal CONT1. In this arrangement, the positive voltage as a control voltage is applied to the voltage control terminal CONT1, so that the PIN diodes D2 and D3 are in the on-state. Therefore, the band-varying capacitors C3 and C4 are respectively grounded through the PIN diodes D2 and D3, the two attenuation-pole frequencies are both lowered and the pass band of the transmitting-side circuit 25 is lowered.

In contrast, when a voltage of 0 V is applied to the base of the transistor 13 by the switch 18 of the control circuit 11, the transistors 12 and 13 are in the off-state and then the control circuit 11 has high impedance of 100 kΩ or more (for instance, 100 through 200 MΩ), so that no voltage is applied to the voltage control terminal CONT1. Since no voltage is applied to the voltage control terminal CONT1, the PIN diodes D2 and D3 are in the off-state. This permits the band-varying capacitors C3 and C4 to be in the open-state, whereby the two attenuation-pole frequencies are both heightened and the pass band of the transmitting-side circuit 25 is heightened. In such a manner, the transmitting-side circuit 25 can have the two different pass-band characteristics by grounding or opening the band-varying capacitors C3 and C4 by performing voltage control.

Figure 4:
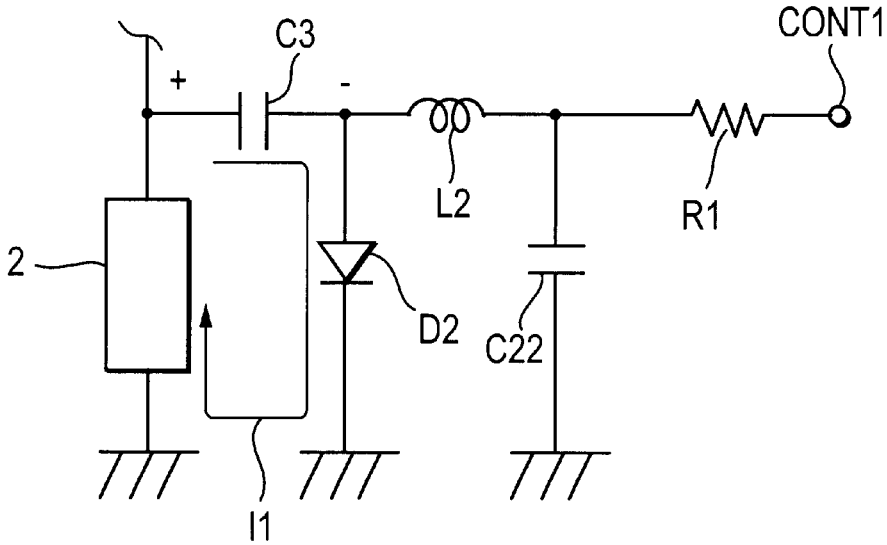
FIG. 4 is a view for illustrating the operation of the antenna duplexer shown in FIG. 1.
Figure 5:
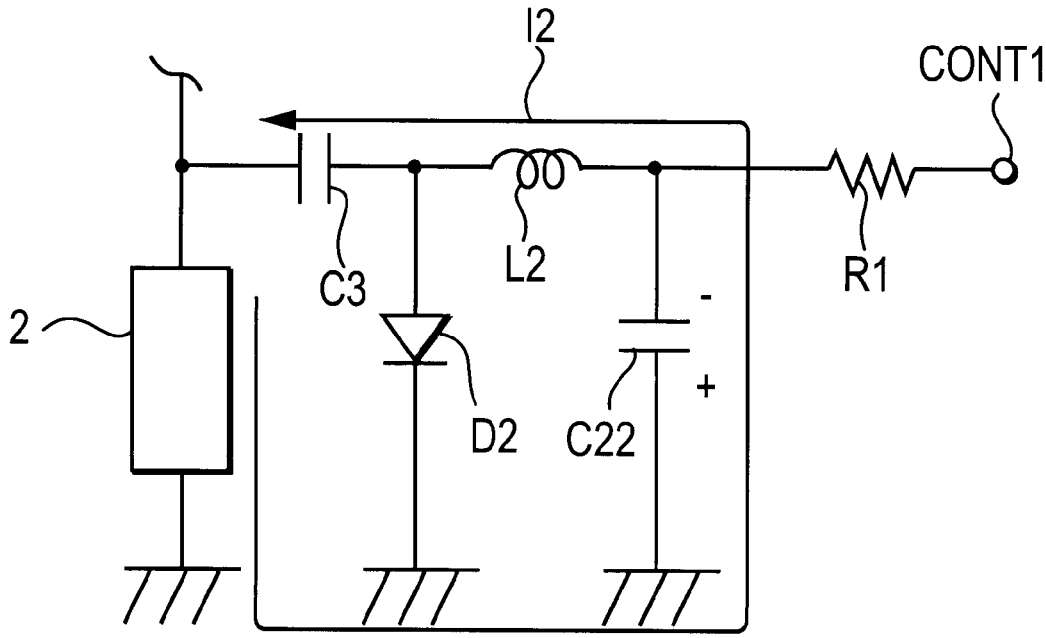
FIG. 5 is a view for illustrating the operation of the antenna duplexer shown in FIG. 1.

In the antennas duplexer 1, high-frequency signals of large electric power (about 0.5 through 3 W) are input from the transmission terminal Tx, and applied to the transmitting-side filter circuit 27 and the receiving-side filter circuit 28. As shown in FIG. 4 and FIG. 5, the large-power high-frequency signals generate two kinds of current $I_1$ and $I_2$ in each of the resonance systems of the resonators 2, 3, through 6. Furthermore, these two kinds of current $I_1$ and $I_2$ flow in such a manner that a negative voltage is constantly applied to the anode of the PIN diodes D2, D3, through D6, by allowing the control circuit 11 connected to the voltage control terminal 1 to be in high impedance. Thus, even though the large-power high-frequency signals are input, a negative voltage is constantly applied to the PIN diodes D2 and D3, so that the PIN diodes D2 and D3 are not in the on-state.

The passing frequency of the frequency-variable-type band pass filter circuit 28 in the receiving-side circuit 26 is determined by each resonance frequency of a resonance system formed by the band-varying capacitor C7, the resonance inductor L9, and the resonator 4, a resonance system formed by the band-varying capacitor C8 and the resonator 5, and a resonance system formed by the band-varying capacitor C9, the resonance inductor L10, and the resonator 6. When a positive voltage as a control voltage is applied to the voltage control terminal CONT2 from the control circuit connected to the voltage control terminal CONT2 by the same operation as the above-described one, the PIN diodes D4, D5, and D6 are in the on-state. Thus, the band-varying capacitors C7, C8, and C9 are grounded through the PIN diodes D4, D5, and D6, whereby the passing frequencies is lowered.

In contrast, when no control voltage is applied to the voltage control terminal CONT2, the PIN diodes D4, D5, and D6 are in the OFF-state. This permits the band-varying capacitors C7, C8, and C9 to be in the open-state, whereby the passing frequency is heightened. In such a manner, the receiving-side circuit 26 can have the two different pass-band characteristics by grounding or opening the band-varying capacitors C7 through C9 by performing voltage control.

In the frequency-variable-type band pass filter circuit 28, voltage control is performed in such a manner that it allows the band pass frequency to be lower when a low-frequency pass band is selected as a transmitting band, whereas it allows the band pass frequency to be higher when a high-frequency pass band is selected as a transmitting band, corresponding to the switching of the two high/low pass bands of the transmitting-side circuit 25. In this arrangement, the phase combination with the transmitting-side circuit 25 is ideally performed.

In this manner, when the PIN diodes D2 through D6 are in the off-state, even if large-power high-frequency signals are input from the transmission terminal Tx or the like, since a negative voltage is applied constantly to the anode of the PIN diodes D2 through D6, the antennas duplexer 1 can have a stable frequency characteristic. In addition, the control circuit 11 does not need a power-supply circuit for generating a negative voltage, whereby it is a simple circuit so that miniaturization and cost reduction of the communication apparatus can be achieved.

Figure 6:
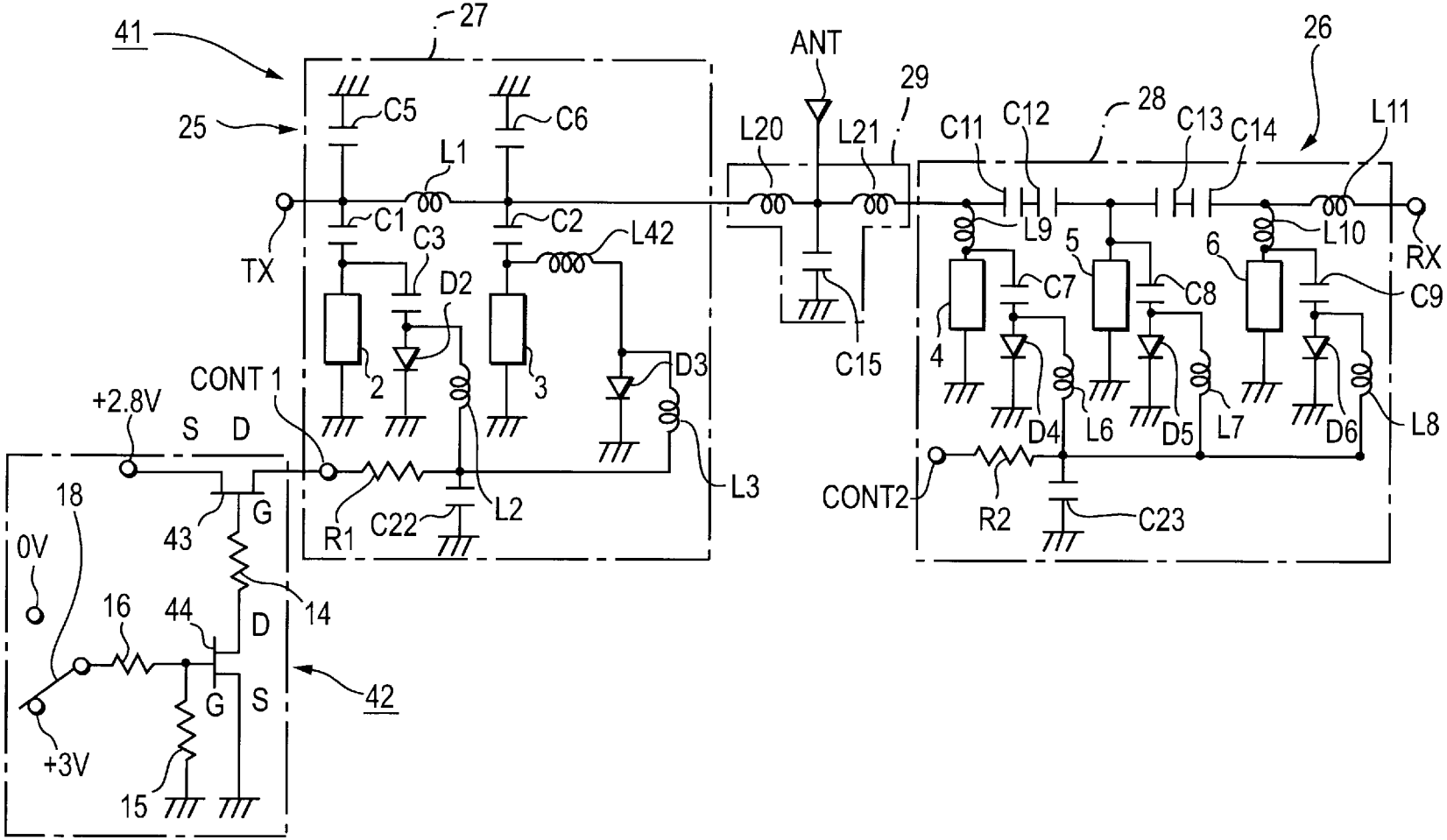
FIG. 6 is an electric circuit diagram of an antenna duplexer and a control circuit for showing a second preferred embodiment of a communication apparatus according to the present invention.

[Second Preferred Embodiment, FIG. 6]

FIG. 6 shows a structure of an antenna duplexer 41 and a control circuit 42 inside a communication apparatus of a second preferred embodiment. The antenna duplexer 41 is the same as the antenna duplexer 1 incorporating an inductor L42 as an alternative to the band-varying capacitor C4. The control circuit 42 is the same as the control circuit 11 of the first embodiment incorporating field-effect transistors (FET) 43 and 44 as alternatives to the transistors 12 and 13. The antenna duplexer 41 and the control circuit 42 having the structures above can achieve the same operational advantages as those in the antenna duplexer 1 and the control circuit 11 used in the first preferred embodiment.

Figure 7:
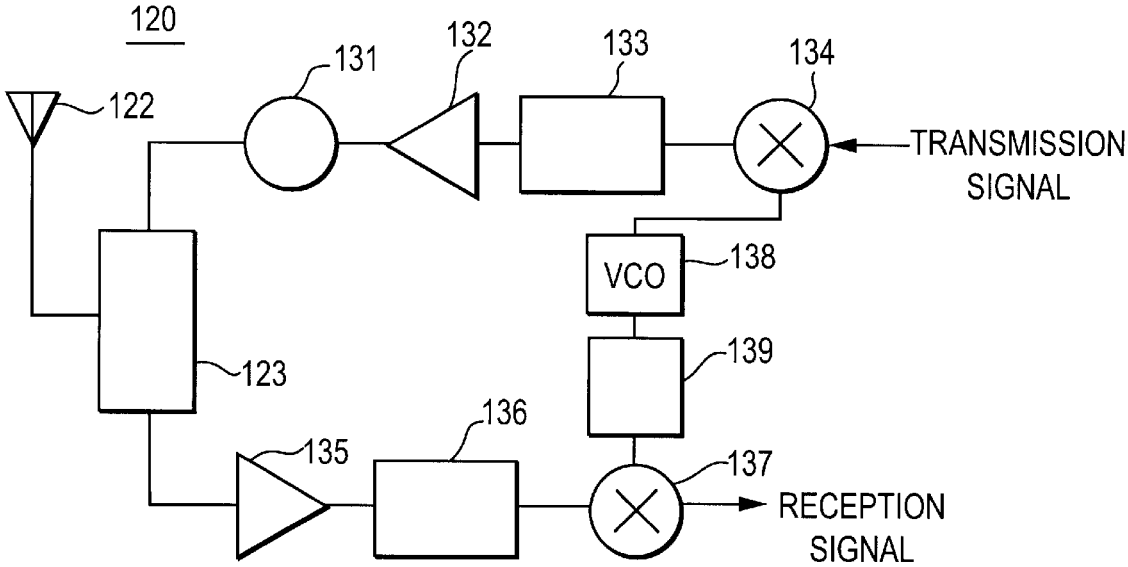
FIG. 7 is a block diagram for showing a third preferred embodiment of the communication apparatus according to the present invention.

[Third Preferred Embodiment, FIG. 7]

A third embodiment of the communication apparatus according to the present invention will be described referring to an example of a mobile phone.

FIG. 7 is an electric circuit block diagram of the RF part of a mobile phone 120. In FIG. 7, 122 is an antenna device, 123 is a duplexer, 131 is a transmitting-side isolator, 132 is a transmitting-side amplifier, 133 is a transmitting-side inter-stage band-pass filter, 134 is a transmitting-side mixer, 135 is a receiving-side amplifier, 136 is a receiving-side inter-stage band-pass filter, 137 is a receiving-side mixer, 138 is a voltage-controlled oscillator (VCO), and 139 is a local band pass filter.

In this case, it is possible to use a duplexer, in which the antenna duplexers 1 and 41 and the control circuits 11 and 42 of the first and second preferred embodiments are combined as the duplexer 123. With the antenna duplexers 1 and 41 and the control circuits 11 and 42 mounted, a compact mobile phone having a stable frequency characteristic can be obtained. Moreover, as the transmitting-side and receiving-side inter-stage band-pass filters 133 and 136 and the local band-pass filter 139, for example, a filter, in which the frequency-variable-type filter circuit 28 and the control circuit 11 shown in FIG. 1 are combined, can be used.

Furthermore, the frequency-variable-type filter, the antenna duplexer, and the communication apparatus according to the present invention should not be limited to the embodiments above described, and various modifications can be applied within the range of the scope and spirits of the invention.

While the invention has been particularly shown and described with reference to preferred embodiments thereof, it will be understood by those skilled in the art that the forgoing and other changes in form and details may be made therein without departing from the spirit of the invention.

What is claimed is:

1. A frequency-variable-type filter, comprising:

a voltage control terminal;

at least one resonator;

a switching device which is switched on/off by a control voltage supplied to the voltage control terminal; and a control circuit electrically connected to the voltage control terminal;

wherein said control has a high impedance and imposes a negative voltage on said switching device in response to a 0 V input voltage to said control circuit, thereby placing the switching device in the off-state.

2. The frequency-variable-type filter according to claim 1, wherein the switching device is a PIN diode.

3. The frequency-variable-type filter according to claim 2, wherein the anode of the PIN diode is electrically connected to the resonator through one of an inductor and a capacitor;

the cathode of the PIN diode is electrically connected to a ground;

the voltage control terminal is electrically connected to the anode of the PIN diode through a choke coil; and a noise-cutting bypass capacitor is electrically connected between the voltage control terminal and said ground.

4. The frequency-variable-type filter according to claim 3, wherein the impedance of the choke coil is 350 Ω or more, and the capacitance of the noise-cutting bypass capacitor is in a range of 10 through 1000 pF.

5. The frequency-variable-type filter according to claim 1, wherein the resonator is a dielectric resonator.

6. An antenna duplexer, comprising a first filter and a second filter, said first and second filters being connected in parallel to an antenna terminal, one of said filters being the frequency-variable-type filter according to claim 1.

7. A communication apparatus, comprising:

a frequency-variable-type filter comprising a voltage control terminal; at least one resonator; and a switching device which is switched on/off by a control voltage supplied to the voltage control terminal; and a control circuit which supplies a control voltage to the voltage control terminal to perform voltage control of the frequency-variable-type filter;

wherein the control circuit has high impedance and imposes a negative voltage on the switching device in response to a 0 V input voltage to said control circuit, thereby placing the switching device in the off-state.

8. The communication apparatus according to claim 7, wherein the switching device is a PIN diode.

9. The communication apparatus according to claim 8, wherein the anode of the PIN diode is electrically connected to the resonator through one of an inductor and a capacitor;

the cathode of the PIN diode is electrically connected to a ground;

the voltage control terminal is electrically connected to the anode of the PIN diode through a choke coil; and a noise-cutting bypass capacitor is electrically connected between the voltage control terminal and said ground.

10. The communication apparatus according to claim 9, wherein the impedance of the choke coil is 350 Ω or more, and the capacitance of the noise-cutting bypass capacitor is in a range of 10 through 1000 pF.

11. A communication apparatus, comprising:

a frequency-variable-type filter comprising a voltage control terminal; at least one resonator; and a switching device which is switched on/off by a control voltage supplied to the voltage control terminal; and a control circuit which supplied a control voltage to the voltage control terminal to perform voltage control of the frequency-variable-type filter;

the switching device being in the off-state and the control circuit having a high impedance in response to a 0 V input voltage to said control circuit;

wherein the impedance of the control circuit is 100 kΩ or more when the control circuit has a high impedance at a 0 V input voltage.

12. The communication apparatus of claim 11, wherein the control circuit has high impedance and imposes a negative voltage on the switching device in response to a 0 V input voltage to said control circuit, thereby placing the switching device in the off-state.

13. A communication apparatus, comprising:

a frequency-variable-type filter comprising a voltage control terminal; at least one resonator; and a switching device which is switched on/off by a control voltage supplied to the voltage control terminal; and a control circuit which supplies a control voltage to the voltage control terminal to perform voltage control of the frequency-variable-type filter;

the switching device being in the off-state and the control circuit having a high impedance in response to a 0 V input voltage to said control circuit;

wherein the control circuit has a transistor.

14. The communication apparatus of claim 13, wherein the control circuit has high impedance and imposes a negative voltage on the switching device in response to a 0 V input voltage to said control circuit, thereby placing the switching device in the off-state.

15. A communication apparatus, comprising:

a frequency-variable-type filter comprising a voltage control terminal; at least one resonator; and a switching device which is switched on/off by a control voltage supplied to the voltage control terminal; and a control circuit which supplies a control voltage to the voltage control terminal to perform voltage control of the frequency-variable-type filter;

the switching device being in the off-state and the control circuit having a high impedance in response to a 0 V input voltage to said control circuit;

wherein the control circuit has a field-effect transistor.

16. The communication apparatus of claim 15, wherein the control circuit has high impedance and imposes a negative voltage on the switching device in response to a 0 V input voltage to said control circuit, thereby placing the switching device in the off-state.

17. A communication apparatus, comprising:

a frequency-variable-type filter comprising a voltage control terminal; at least one resonator; and a switching device which is switched on/off by a control voltage supplied to the voltage control terminal; and a control circuit which supplies a control voltage to the voltage control terminal to perform voltage control of the frequency-variable-type filter;

the switching device being in the off-state and the control circuit having a high impedance in response to a 0 V input voltage to said control circuit;

wherein the resonator is a dielectric resonator.

18. The communication apparatus of claim 17, wherein the control circuit has high impedance and imposes a negative voltage on the switching device in response to a 0 V input voltage to said control circuit, thereby placing the switching device in the off-state.

* * * * *